United States Patent [19]

Glaser, Jr.

[11] 4,417,105

[45] Nov. 22, 1983

[54] MEMBRANE SWITCH ASSEMBLY WITH MODULAR SWITCH PORTIONS

[75] Inventor: Nicholas W. Glaser, Jr., Milwaukee, Wis.

[73] Assignee: W. H. Brady Co., Milwaukee, Wis.

[21] Appl. No.: 314,542

[22] Filed: Oct. 26, 1981

[51] Int. Cl.[3] ..... H01H 13/70

[52] U.S. Cl. ..... 200/5 A; 200/159 B; 200/307

[58] Field of Search ..... 200/5 A, 38 FB, 159 R, 200/307

[56] References Cited

U.S. PATENT DOCUMENTS

| | | | |
|---|---|---|---|
| Re. 30,435 | 11/1980 | Fukao | 200/307 X |
| 3,970,812 | 7/1976 | Nowack | 200/307 |
| 4,127,740 | 11/1978 | La Marche | 200/5 A X |
| 4,224,484 | 9/1980 | Haas et al. | 200/38 FB |
| 4,303,811 | 12/1981 | Parkinson | 200/5 A |

*Primary Examiner*—J. R. Scott

[57] ABSTRACT

Custom membrane switch assemblies comprising a plurality of switch modules of different sizes.

4 Claims, 3 Drawing Figures

MEMBRANE SWITCH ASSEMBLY WITH MODULAR SWITCH PORTIONS

FIELD OF THE INVENTION

Figure 1:
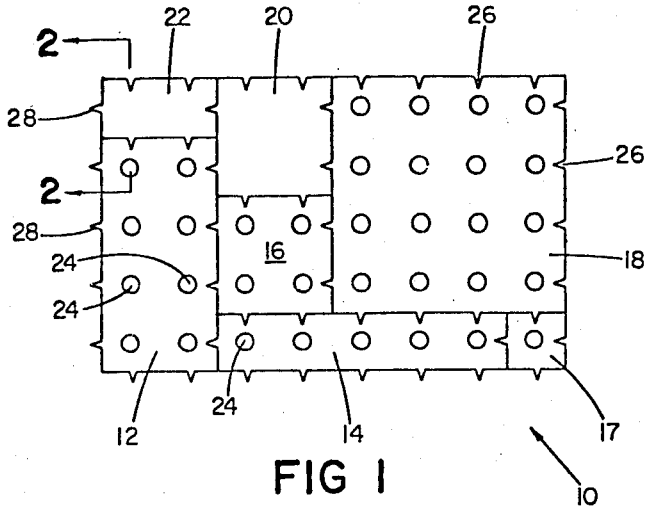

This invention relates to membrane switch assemblies with modular switch portions.

BACKGROUND OF THE INVENTION

It would be desirable if it were possible to make up custom membrane switch assemblies using stock switch portions. This would enable reduced custom work and undue expense, and enable reducing inventory.

It has been known to provide a kit in which a multiplicity of identical switch-strip sub-units may be used together to make up a membrane switch assembly as desired; such a kit is disclosed in Wayne K. Parkinson's pending application Ser. No. 99,628, "Kit For Use in the Construction of Custom Prototype Membrane Switch Panels", filed Dec. 3, 1979, now U.S. Pat. No. 4,303,811. This application also asserts that "particular switch strips may be cut down, at their ends away from their tails, to provide less than five switches".

SUMMARY OF THE INVENTION

I have discovered that desired custom membrane switch assemblies may be provided using stock switch portions. This may be accomplished by providing a plurality of switch modules, of different size, but adapted to be used together. In preferred embodiments, switches of a particular module are spaced on equidistant centers, and each outer module dimension is an integer times a distance equal to said space; and locating means are providing to relatively locate adjacent modules.

PREFERRED EMBODIMENT

I turn now to preferred embodiments of the invention.

DRAWINGS

There is shown in the drawings said preferred embodiments.

In FIG. 1 is shown a somewhat diagrammatic plan view of the module layer.

Figure 2:
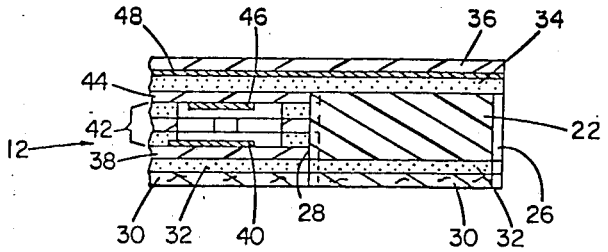

In FIG. 2 is shown a partial sectional view through the membrane assembly including said module layer.

Figure 3:
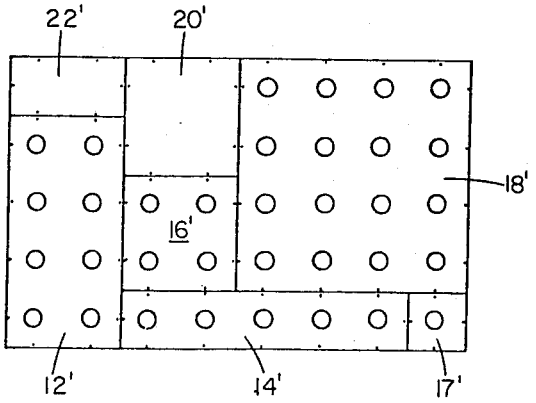

In FIG. 3 is shown a somewhat diagrammatic plan view of a modified embodiment of the module layer.

Structure

There is shown in FIG. 1 an array of modules interdigitated to form a switch layer indicated generally at 10. Switch layer 10 consists of switch module 12, switch module 14, switch module 16, switch module 17, switch module 18, spacer module 20, and spacer module 22.

Individual switch zones are indicated somewhat diagrammatically at 24. The center-to-center spacing between any two individual switch zones 24 is identical throughout each of the switch modules. Furthermore, because each side of each switch module 12, 14, 16, 17, and 18 is an integer times said center-to-center spacing, the same center-to-center switch zone spacing is maintained also as between adjacent switch modules. Thus, referring to the center-to-center spacing as X, module 12 has outer dimensions of 2X by 2X, module 14 of X by 5X, module 16 of 2X by 2X, module 17 of X by X, and module 18 of 4X by 4X.

The outer dimensions of spacer 20 are 2X by 2X and of spacer 22 2X by X.

On two sides of each switch module is or are provided one or more grooves 26, spaced a distance X apart. On the other two edges of each switch module are provided fitting projections 28. Spacer modules 20, 22 are similarly provided.

In FIG. 2 is shown a partial sectional view of the entire switch assembly. This assembly includes spacer module 22, layer of adhesive 34, layer of ink 48, and transparent plastic cover layer 36 overlying the entire assembly. Specific materials used may be as set forth in the above-referred-to disclosure of Wayne K. Parkinson.

Switch module 12, indicated generally at FIG. 2, includes release liner 30, layer of adhesive 32, plastic lower contact sheet 38, bearing conductive ink switching portion 40, spacer 42, and upper plastic switching layer 44 bearing conductive ink contact 46.

Each switch module is provided with a tail (not shown) extending from its lower portion and bearing conductive tracks, all as disclosed in Parkinson U.S. Pat. No. 4,218,600, "Connecting Flexible Switch", granted Aug. 9, 1980, and Kissner U.S. Pat. No. 4,217,473, "Connecting Flexible Switch", granted Aug. 12, 1980.

In the embodiment of FIG. 3, the alignment indicia are optical, being spots 50 of conductive ink deposited simultaneously with contacts 46. Modules 22', 12', 20', 16', 14', 17' and 18' are the same shape as the respective modules illustrated in FIG. 1. Indeed, this embodiment is my presently most-preferred embodiment.

Operation

In operation, the desired arrangement of stock modules may as desired by assembled with overlay sheet 36 bearing adhesive layer 34. This permits production of a custom assembly, with a customized overlay layer 36, while enabling use of non-customized switch modules.

Relating the center-to-center switch space and the switch module outer dimensions as disclosed results in the desirable orientation of switching zones in regular horizontal and vertical rows throughout the multi-module switch assembly.

OTHER EMBODIMENTS

Other embodiments will occur to those skilled in the art.

The spacer module 22 can be unitary in thickness or laminated or made from any of many different materials.

A module assembly may include as few as two switch modules and no spacer modules; in fact, the most frequent commercial embodiment may have three switching modules.

RELATED INVENTIONS

The conception of spacer modules embodied in the preferred embodiment herein is that of my colleague, H. J. Wise.

What is claimed is:

1. A membrane switch assembly comprising a plurality of modular switch portions, one said modular switch portion including a plurality of switching zones arranged in at least two columns to form rows and columns, the center-to-center distance between adjacent said switching zones in a row and in a column being X, said modular portion having an edge spaced from adjacent said zones by a distance of X/2, another said modular switch portion having at least one column of switching zones spaced from adjacent zones by X, and having an edge spaced from adjacent said zones by a distance of X/2.

2. The assembly of claim 1 in which said modular switch portions include relative locating means at an edge thereof.

3. The assembly of claim 1 in which said relative locating means are mating grooves and notches.

4. The assembly of claim 1 in which said relative locating means are optical indicia.

* * * * *

UNITED STATES PATENT AND TRADEMARK OFFICE

CERTIFICATE OF CORRECTION

PATENT NO. : 4,417,105

DATED : November 22, 1983

INVENTOR(S) : Nicholas W. Glaser, Jr.

It is certified that error appears in the above-identified patent and that said Letters Patent is hereby corrected as shown below:

Col. 1, line 68, "2X by 2X" should be -- 2X by 4X --.
Col. 2, line 26, "Aug. 9," should be -- Aug. 19 --.
Col. 4, line 4, "claim 1" should be -- claim 2 --.
Col. 4, line 7, "claim 1" should be -- claim 2 --.

Signed and Sealed this

Thirtieth Day of December, 1986

*Attest:*

DONALD J. QUIGG

*Attesting Officer*

*Commissioner of Patents and Trademarks*